US006524132B1

(12) United States Patent
Nagai

(10) Patent No.: US 6,524,132 B1
(45) Date of Patent: Feb. 25, 2003

(54) FLYBACK TRANSFORMER

(75) Inventor: Tadao Nagai, Shiga-ken (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 09/691,176

(22) Filed: Oct. 19, 2000

Related U.S. Application Data

(62) Division of application No. 09/109,728, filed on Jul. 2, 1998, now Pat. No. 6,188,303.

(30) Foreign Application Priority Data

Jul. 9, 1997 (JP) ..... 9-183740

(51) Int. Cl.[7] ..... H01R 9/05
(52) U.S. Cl. ..... 439/578; 439/460
(58) Field of Search ..... 439/578, 63, 595, 439/584, 449, 456, 457, 460

(56) References Cited

U.S. PATENT DOCUMENTS

| | | | | |
|---|---|---|---|---|
| 3,585,450 A | | 6/1971 | Lane | |
| 3,766,505 A | | 10/1973 | Sato et al. | 336/94 |
| 3,813,574 A | | 5/1974 | Sato | 361/146 |
| 4,033,535 A | * | 7/1977 | Moran | 174/153 G |
| 4,050,772 A | | 9/1977 | Birnholz et al. | |
| 4,074,210 A | | 2/1978 | Otake et al. | 333/156 |
| 4,408,176 A | | 10/1983 | Nakamura | 336/107 |
| 5,030,136 A | * | 7/1991 | Reinhardt et al. | 439/392 |
| 5,131,864 A | * | 7/1992 | Van Zeelst et al. | 174/65 SS |
| 5,389,012 A | * | 2/1995 | Huang | 439/578 |
| 5,466,173 A | * | 11/1995 | Down | 439/578 |
| 5,488,268 A | * | 1/1996 | Bauer et al. | 315/57 |
| 5,494,454 A | * | 2/1996 | Johnsen | 439/394 |
| 5,532,669 A | | 7/1996 | Tsunezawa et al. | 338/184 |
| 6,146,196 A | * | 11/2000 | Burger et al. | 439/578 |
| 6,250,959 B1 | * | 6/2001 | Yamaguchi et al. | 439/578 |
| 6,280,262 B1 | * | 8/2001 | Tanaka | 439/595 |

FOREIGN PATENT DOCUMENTS

| | | |
|---|---|---|
| JP | 5-101861 | 4/1993 |
| JP | 8-83726 | 3/1996 |
| JP | 9-134833 | 5/1997 |

* cited by examiner

*Primary Examiner*—Tulsidas Patel
(74) *Attorney, Agent, or Firm*—Burns, Doane, Swecker & Mathis, LLP

(57) ABSTRACT

A flyback transformer includes an anode lead wire composed of a core wire and an insulating film for covering the core wire and supplying a high output voltage to a CRT. A cylindrical anode lead holding device includes engagement pieces have spring-like properties which allows the pieces to restore to their original positions after having been extended in a radial direction. These engagement pieces project from the inner surface of the anode lead holding device and hold the anode lead wire. The anode lead wire has a groove engages the engagement pieces, such that the anode lead wire is held by the anode lead holding device.

8 Claims, 4 Drawing Sheets

FIG. 4
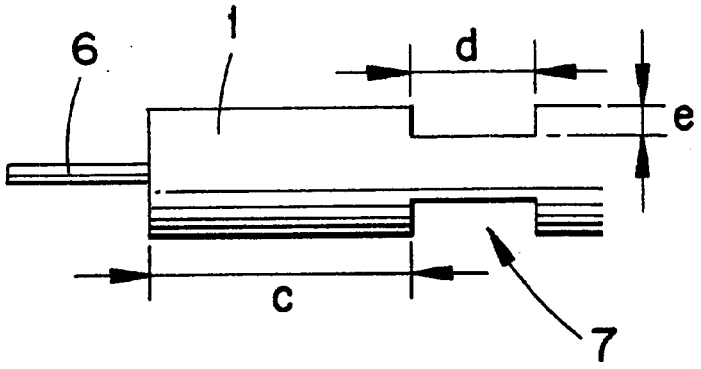
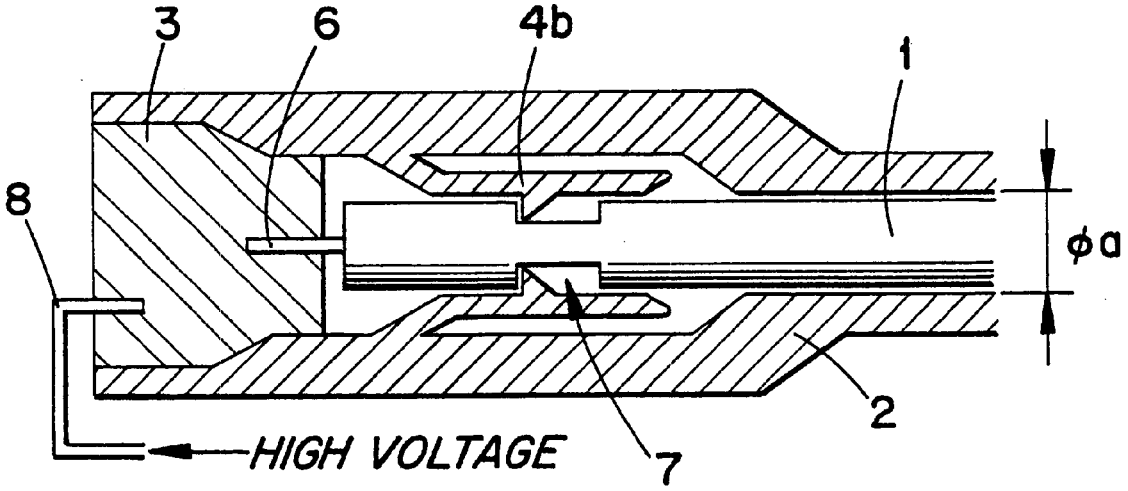
FIG. 5

FIG. 6
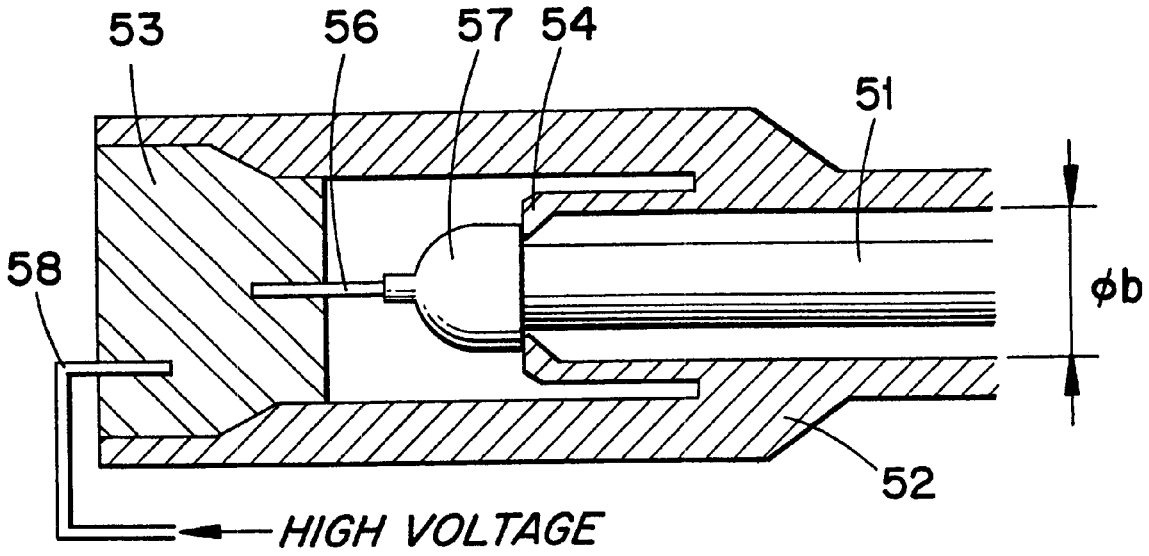
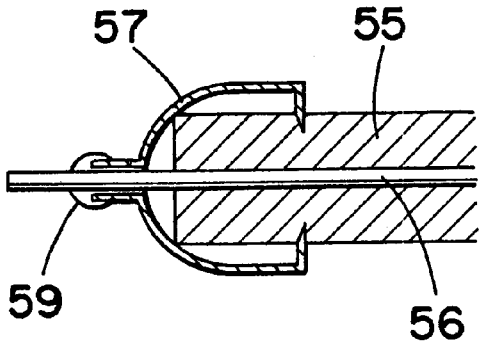
FIG. 7

FLYBACK TRANSFORMER

This application is a Divisional of Ser. No. 09/109,728 filed Jul. 2, 1998, U.S. Pat. No. 6,188,303.

This application corresponds to Japanese Patent Application No. 9-183740, filed on Jul. 9, 1997, which is hereby incorporated by reference in its entirety.

BACKGROUND OF THE INVENTION

1. Field of the Invention

The present invention relates to a flyback transformer which is used in a television receiver and other devices, and more particularly, to the structure of an anode lead wire used for connecting the flyback transformer and a cathode ray tube (CRT).

2. Description of the Related Art

Hitherto, flyback transformers have been installed in television receivers or display apparatuses. In such an application, a high output voltage is applied from high-tension coils (e.g., secondary coils) used in the flyback transformers to anodes used in cathode ray tubes through anode lead wires. In recent years, a so-called anode-lead-wire-post-mounting technique has become prevalent as a step in the assembly of television receivers and like display apparatuses. In this process, the anode lead wire is mounted to the flyback transformer after the flyback transformer has been installed in the television receiver or display apparatus so as to facilitate assembly.

FIG. 6 shows the connection mechanism of an anode lead wire in a conventional flyback transformer produced by the above-described technique of anode-lead-wire-post-mounting. The connection mechanism used to connect the anode lead wire 51 is mainly composed of the anode lead wire 51, an anode lead holder 52 and a conductive rubber member 53 (e.g., conductive rubber member 53 may comprise rubber or other resilient material with conductive material added thereto). The anode lead holder 52 is formed in a cylindrical shape and is made of an insulating resin material. The anode lead holder 52 has engagement pieces 54 having resilient properties when extended in an inward (radial) direction. The engagement pieces 54 project from the inner surface of the anode lead holder 52. The anode lead wire 51 is inserted from one opening (the right end in FIG. 6) of the anode lead holder 52, and the conductive rubber 53 is pressed into the other opening (the left end in FIG. 6) and fixed thereto. A high-voltage lead wire 58 for providing a high voltage output from a high-tension coil (e.g., a secondary coil) is thrust into the conductive rubber 53. The inner diameter "b" of the anode lead holder 52 is defined by the size of a connecting fitting 57 mounted to the head of the anode lead wire 51.

As shown in FIG. 7, an insulating film 55 at the head of the anode lead wire 51 is removed to expose a core wire 56. In addition, a metal connecting fitting 57 is attached to the head. To attach the connecting fitting 57 to the anode lead wire 51, the edges of the connecting fitting are tapered so that they cut into and engage the insulting film 55. Also, the core wire 56 and connecting fitting 57 are secured by solder 59.

A series of operations used to secure the anode lead holder 52 to the anode lead wire 51 will now be described. The anode lead wire 51 having the connecting fitting 57 attached to the head thereof is first inserted from one opening (e.g., the right opening) of the anode lead holder 52. When the connecting fitting 57 engages the engagement pieces 54, the connecting fitting 57 is advanced so as to gradually expand the space between the tips of the engagement pieces 54, and the head of the core wire 56 is thrust into the conductive rubber 53. When the connecting fitting 57 is advanced such that the portion thereof which cuts into the insulating film 55 passes the tips of the engagement pieces 54, the engagement pieces 54 return to their original state as a result of the elastic restoring force thereof. In this state, the engagement of the connecting fitting 57 with the engagement pieces 54 allows the anode lead wire 51 to be retained. That is, the engagement pieces 54 thereby prevent the anode lead wire 51 from falling out, so that the anode lead wire 51 is held and fixed to the anode lead holder 52.

The conventional flyback transformer encounters at least the following problems.

The connecting fitting 57 is required to be attached to the head of the anode lead wire 51, so that the number of components is increased and the operation of mounting the connecting fitting 57 requires much labor, resulting in an increase in cost.

In addition, it is necessary to widen the inner diameter "b" of the anode lead holder 52 to accommodate the relatively large size of the connecting fitting 57, resulting in an increase in size of the anode lead holder 52.

SUMMARY OF THE INVENTION

Accordingly, it is an object of the present invention to provide a flyback transformer in which the head of the anode lead wire can be easily processed, and in which the connection mechanism for connecting the anode lead wire to the anode lead holder can be reduced in size.

According to an exemplary aspect of the present invention, there is provided a flyback transformer including a transformer section including a magnetic core incorporated into a coil. An anode lead wire is composed of a core wire and an insulating film for covering the core wire. The anode lead wire is used for supplying a high output voltage generated in the transformer section to a CRT. A cylindrical anode lead holding means is provided which has at least one engagement piece which is elastic in at least the radial inward direction of the anode lead holding means. The at least one engagement piece projects from the inner surface of the anode lead holding means and holds the anode lead wire. The anode lead wire has a groove formed on a part of or around the whole circumference of the insulating film. The groove engages with the at least one engagement piece, whereby the anode lead wire is securely held by the anode lead holding means.

According to another exemplary aspect of the present invention, there is provided a flyback transformer including a transformer section formed by a magnetic core incorporated into a low-tension coil part and a high-tension coil part. The anode lead wire is composed of a core wire and an insulating film for covering the core wire and for supplying a high output voltage generated in the transformer section to a CRT. A cylindrical anode lead holder is provided having at least one engagement piece which is elastic in at least the radial direction of the anode lead holder. The at least one engagement piece projects from the inner surface of the anode lead holder and holds the anode lead wire. A conductive rubber member is provided on a high voltage extraction portion of the transformer section and is electrically connected to the core wire of the anode lead wire. The anode lead wire has a groove formed on a part of or around the whole circumference of the insulating film. The groove engages with the at least one engagement piece, whereby the anode lead wire is held by the anode lead holder.

With the described arrangements, by only partially removing the insulating film of the anode lead wire to form the groove, without attaching a connecting fitting to the head of the anode lead wire, the anode lead wire can be fixed to the anode lead holder without incurring the disadvantages discussed above.

BRIEF DESCRIPTION OF THE DRAWINGS

The foregoing, and other, objects, features and advantages of the present invention will be more readily understood upon reading the following detailed description in conjunction with the drawings in which:

FIG. 4 is an enlarged sectional view showing the head of an anode lead wire;

FIG. 5 is a sectional view showing the connection mechanism of an anode lead wire in a flyback transformer according to a second embodiment of the present invention;

FIG. 6 is a sectional view showing a connection mechanism an anode lead wire in a conventional flyback transformer;

FIG. 7 is a sectional view showing a mounting state of a connecting fitting in a conventional flyback transformer.

DESCRIPTION OF THE PREFERRED EMBODIMENTS

Exemplary embodiments of the present invention will now be described with reference to the accompanying drawings.

Figure 1:
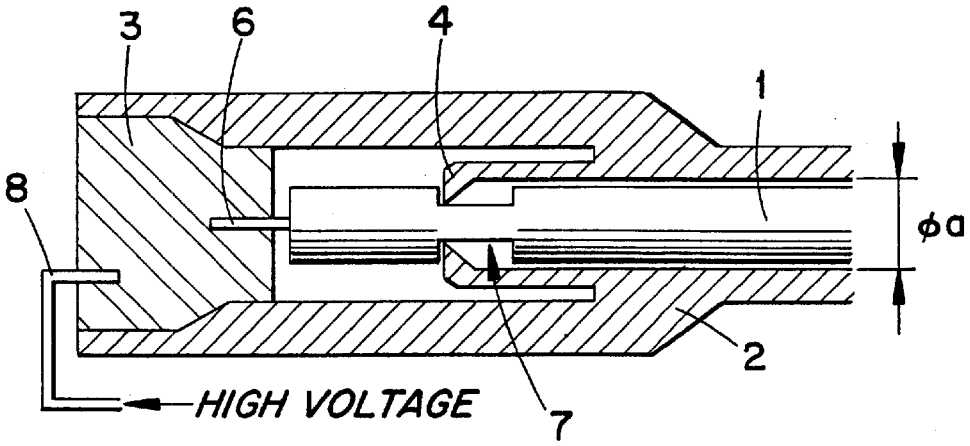
FIG. 1 is a sectional view showing the connection mechanism of an anode lead wire in a flyback transformer according to a first embodiment of the present invention.

FIG. 1 shows a first embodiment of the connection configuration of an anode lead wire, in the context of the anode-lead-wire-post-mounting arrangement of a flyback transformer. However, the connection configuration is applicable to a wide variety of other uses.

The connection configuration of the anode lead wire 1 is, similar to the conventional flyback transformer, principally composed of the anode lead wire 1, an anode lead holder 2 and a conductive nibber member 3. The anode lead holder 2 is formed in a cylindrical or other shape, and can be made of an insulating resin or like material. The anode lead holder 2 also has at least one engagement piece 4 (henceforth referred to as engagement pieces 4) which are resilient, such that the engagement pieces 4 can be extended in the radial (e.g., inward) direction when force is applied thereto, but will spring back to their original positions when the force is removed. These engagement pieces 4 project from the inner surface of the anode lead holder 2. The anode lead wire 1 is inserted from one opening (the right end in FIG. 1) of the anode lead holder 2, and the conductive rubber member 3 is pressed into the other opening (the left end in FIG. 1) and fixed thereto. A high-voltage lead wire 8 for providing a high voltage output from a high-tension coil (e.g., a secondary coil) is thrust into the conductive rubber member 3. The anode lead holder 2 may be formed such that it is integrated with a casing of the flyback transformer, or the anode lead holder 2 can be formed as a separate component. In the latter case, the separate anode lead holder 2 may be mounted to the casing to form the anode lead holder 2.

Figure 8:
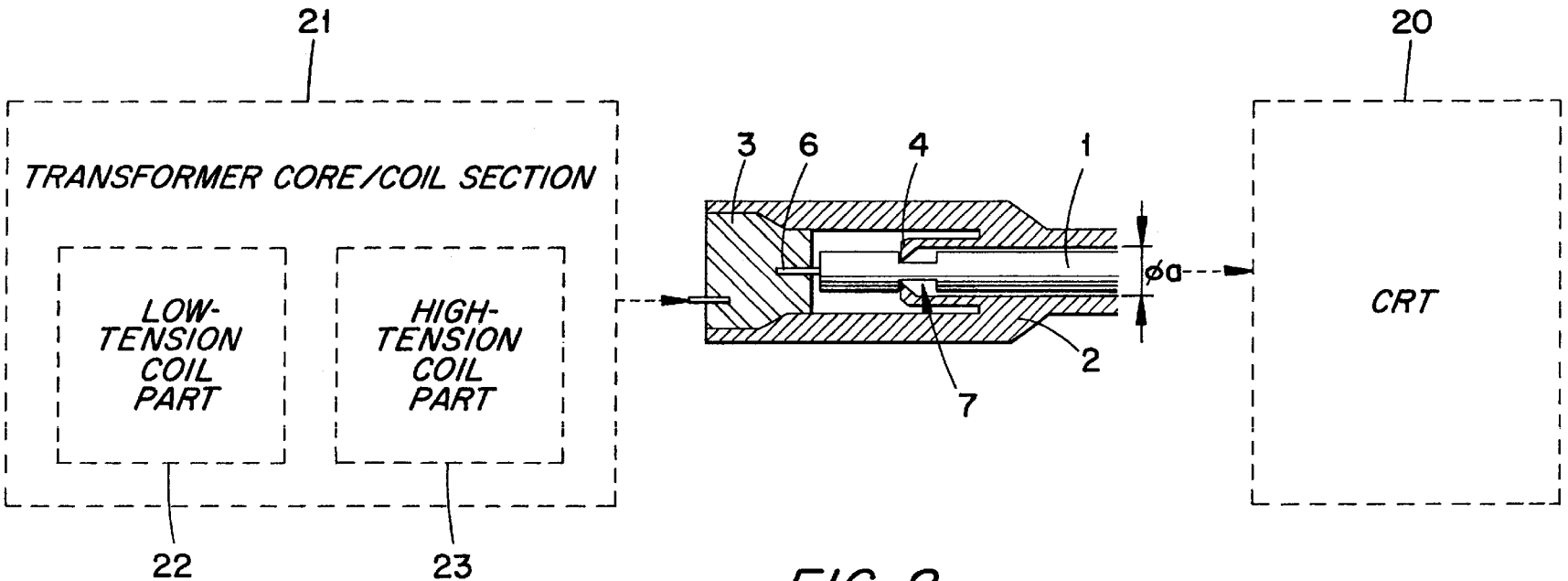
FIG. 8 is a high-level schematic diagram showing the connection mechanism of FIG. 1, a transformer core/coil section and a CRT.

FIG. 8 shows, in high-level depiction, how the connection mechanism of FIG. 1 is connected to the transformer core/coil section 21 and the CRT 20. More specifically, the transformer core/coil section 21 includes a magnetic core and an associated coil. The magnetic core is incorporated into a low-tension coil part 22 and a high-tension coil part 23.

Figure 2:
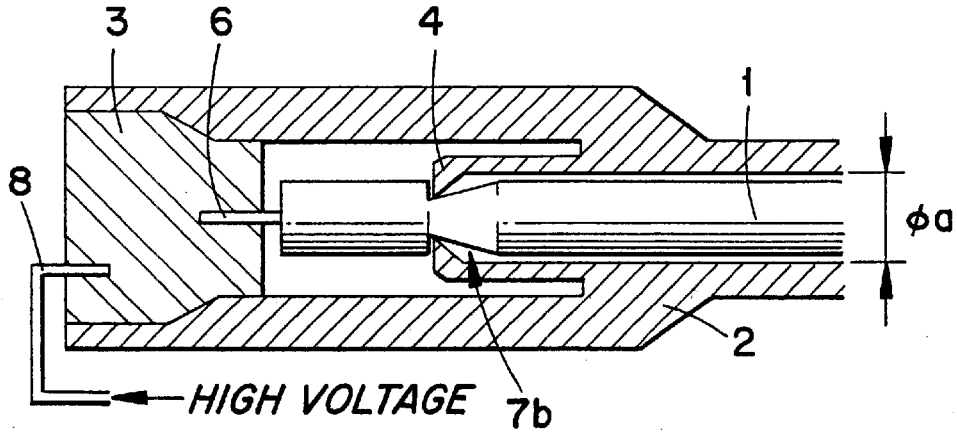
FIG. 2 is a sectional view showing a modification of the first embodiment.
Figure 3:
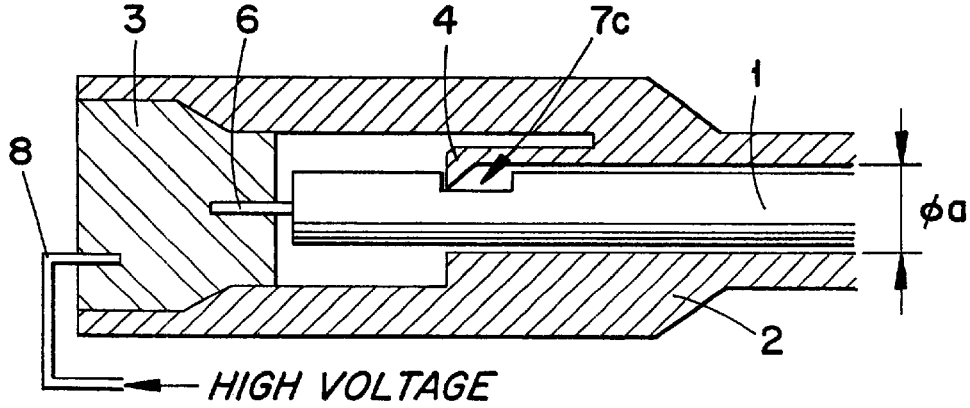
FIG. 3 is a sectional view showing another modification of the first embodiment.

Returning to FIG. 1, an insulating film of the head of the anode lead wire 1 is removed to expose a core wire 6. In addition, a groove 7 is formed around a part of the anode lead wire 1. The groove 7 can be formed by, for example, axially rotating the anode lead wire 1 and by removing the insulating film with an edged tool having the shape of a knife or a chisel (e.g., using a lathe or like instrument). The groove in FIG. 1 is formed by uniformly removing a portion of the insulating film around the entire circumference of the anode lead wire 1 to form a notch having an axial length "d" (e.g., see FIG. 4). The bottom wall of the notch is parallel to the core wire 6. Alternatively, as shown in FIG. 2, a groove 7*b* may be formed into a tapered shape. Still alternatively, only a part of the insulating film may be removed to form the groove 7*c* as shown in FIG. 3, such that the notch does not extend around the entire circumference of the anode lead wire 1.

Generally, the engagement pieces 4 can comprise at least one resilient arm which extends in the axial direction of the anode lead holder 2. In one exemplary embodiment, the arms are attached to the anode lead holder 2 at their respective base portions. When the arms come in contact with the head of the anode lead wire 1, the tips thereof bend in the radial direction of anode lead holder 2. Those skilled in the art will also recognize that other types of engagement mechanisms can be used, such as other types of spring-loaded projections which engage the groove.

An exemplary shape of the groove 7 formed in the anode lead wire 1 will now be described with reference to FIG. 4. The axial length "d" of the groove 7 may be formed within the range of about 0.3 mm to 10 mm. In addition, the depth "e " of the groove 7 may be about 0.2 mm or more. The thickness of the insulating film is preferably preserved to such an extent that the insulating properties of the core wire 6 are sufficiently secured. Further, the distance "c" between the end of the insulating film and the left-most end of the groove 7 may be about 1 mm to 20 mm. By forming the groove 7 into the shape as described above, the strength of anode lead holder 2 in securely holding the anode lead wire 1 is similar to or higher than that of the conventional flyback transformer. These dimensions are exemplary. Different dimensions may be more appropriate depending on the particular application.

The series of operations resulting in the anode lead holder 2 holding the anode lead wire 1 will now be described. The anode lead wire 1 having the groove 7 formed in a part of the insulating film is first inserted from one opening (e.g., the right opening) of the anode lead holder 2. Then, the end portion of the anode lead wire is advanced along the axial direction of the anode lead holder 2. When the head of the anode lead wire 1 contacts the engagement pieces 4, and force is applied to the anode lead wire 1, the space between the tips of the engagement pieces 4 gradually expands. The head of the core wire 6 is thrust into the conductive rubber member 3. When the tips of the engagement pieces 4 come across the groove 7 (or grooves 7*b* or 7*c*) formed in the insulating film, the engagement pieces 4 return to their original state as a result of the elastic restoring force thereof. The engagement of the groove 7 with the engagement pieces 4 allows the anode lead wire 1 to be retained within the anode lead holder 2, and is thereby prevented from slipping out of the anode lead holder 2.

According to the flyback transformer of the present invention, the inner diameter "a" of the anode lead holder 2 is defined by the diameter of the anode lead wire 1, instead of the connecting fitting 57 (as in the case of the conventional configuration described above).

In a flyback transformer according to a second embodiment of the present invention, engagement pieces 4*b* formed on the inner surface of an anode lead holder face in the direction opposite to that of the first embodiment. In other words, in this embodiment, the tip of the engagement piece is located closer to an anode lead wire entrance point (e.g., the right side of the anode lead holder) than the base portion of the engagement piece. In the first embodiment, the base portion is located closer to the anode lead wire entrance point than the tip. Even if the position and the direction of the engagement pieces are changed, the effect of the present invention can be obtained so long as the groove of the anode lead wire and the engagement pieces are located in such a manner that they can be engaged with each other.

In other aspects, the flyback transformer of this embodiment is similar to the flyback transformer of the first embodiment; hence, more description thereof will be omitted.

As described above, the flyback transformer according to the present invention offers at least the following advantages.

It becomes unnecessary to mount a connecting fitting to an anode lead wire when the anode lead wire is fixed to the anode lead holder. This allows the labor required for mounting the connecting fitting to be reduced, and allows the number of components to be reduced, thereby contributing to a reduction in cost of the flyback transformer.

In addition, since the connecting fitting need not be used, the inner diameter of the anode lead holder can be reduced to about the diameter of the anode lead wire itself, so that a reduction in size of the flyback transformer can be achieved.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A connection mechanism for a lead wire, comprising:

a lead wire comprising a core wire and an insulating film for covering said core wire;

a lead holder having at least one engagement piece having elasticity in at least a radial direction of said lead holder, wherein said at least one engagement piece projects from an inner surface of said lead holder;

wherein said lead wire has a groove formed on a section of said insulating film; and wherein said groove engages with said at least one engagement piece, whereby said lead wire is held by said lead holder.

2. The connection mechanism of claim 1, wherein said groove comprises a notch having a length "d", wherein a bottom wall of said notch is parallel with the axial direction of said core wire.

3. The connection mechanism of claim 1, wherein said groove comprises a notch having a length "d", wherein a bottom wall of said notch is inclined with respect to the axial direction of said core wire to thereby form a tapered groove.

4. The connection mechanism of claim 1, wherein said groove comprises a notch which extends around the entire circumference of said lead wire.

5. The connection mechanism of claim 1, wherein said groove comprises at least one notch which extends only partially around the entire circumference of said anode lead wire.

6. The connection mechanism of claim 1, wherein said at least one engagement piece comprises an arm which extends in the axial direction of said lead holder, having a tip and a base portion, wherein the tip can be resiliently extended in the radial direction of said lead holder.

7. The connection mechanism of claim 6, wherein said tip is located closer to a lead wire entrance point than said base portion.

8. The connection mechanism of claim 1, wherein said groove has:

an axial length of about 0.3 mm to 10 mm; and a depth of at least about 0.2 mm.

* * * * *